United States Patent [19]

Cooper

[11] Patent Number: 4,604,935

[45] **Date of Patent: * Aug. 12, 1986**

[54] APPARATUS AND METHOD FOR PROCESSING AUDIO SIGNALS

[75] Inventor: Ellis D. Cooper, New York, N.Y.

[73] Assignee: Joseph A. Barbosa, New York, N.Y.

[ * ] Notice: The portion of the term of this patent subsequent to Apr. 12, 2000 has been disclaimed.

[21] Appl. No.: 134,547

[22] Filed: Mar. 27, 1980

[51] Int. Cl.[4] ..... G10H 1/00

[52] U.S. Cl. ..... 84/1.01

[58] Field of Search ..... 179/15.55 R, 1 D; 84/1.13, 1.25, 1.26; 333/17 L, 14, 166

[56] References Cited

U.S. PATENT DOCUMENTS 3,911,776 10/1975 Beigel ..... 179/1 D
3,962,639 6/1976 Kermode ..... 179/15.55 R
4,021,613 5/1977 Kennedy ..... 179/1 D
4,202,238 5/1980 Moog ..... 84/1.24
4,276,508 6/1981 Usugi ..... 179/1 D

*Primary Examiner*—Gerald L. Brigance
*Attorney, Agent, or Firm*—Joseph A. Barbosa

[57] ABSTRACT

A method and apparatus for transforming audio input signals with variable amplitude and narrow bandwidth into outputs with relatively fixed amplitude and variable bandwidth responsive to input signal amplitude, by the steps of dividing the range of amplitude into an odd number of equal intervals, detecting the interval of amplitude instantaneously occupied by said signal, shifting said instantaneous signal to the central interval, and smoothing the resulting discontinuous signal with a continuous and bilaterally tapered transfer function. This method permits bandwidth expansion and control of the output bandwidth of musical tones produced in electronic musical instruments in response to control of the input amplitude of the tones.

13 Claims, 10 Drawing Figures

M
+T/2
v
-V(MAX)
+V(MAX)
T
KT
T/2
T1

C
2φ
+5
-5
M
-T/2
+T/2 v
31
S
32
+
33
v+s
34
35
MODULIZER
M(v+s)
36
37
CONTINUATOR
c[M(v+s)]
38

+V MAX
-V MAX.
v
40
4(a)
+T/2
-T/2
S
41
4(b)
v
v+s
IN
42
4(c)
M(v+s)
43
4(d)
+5
-5
c[M(v+s)]
44
4(e)

MODULIZER

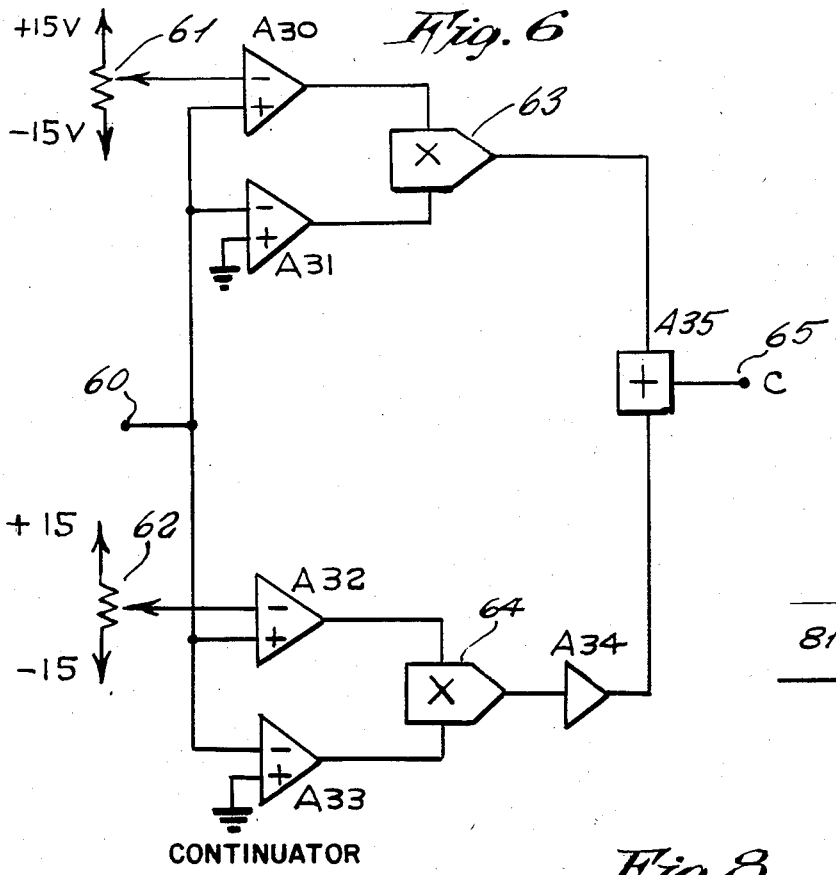
Fig. 6
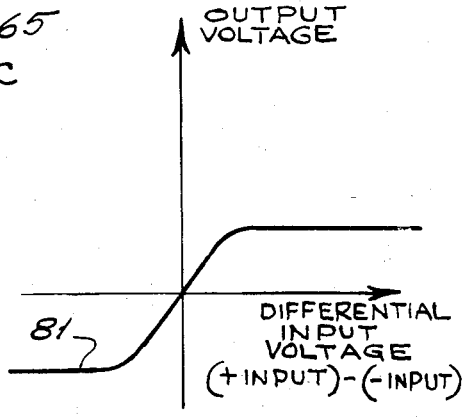
Fig. 7
Fig. 8
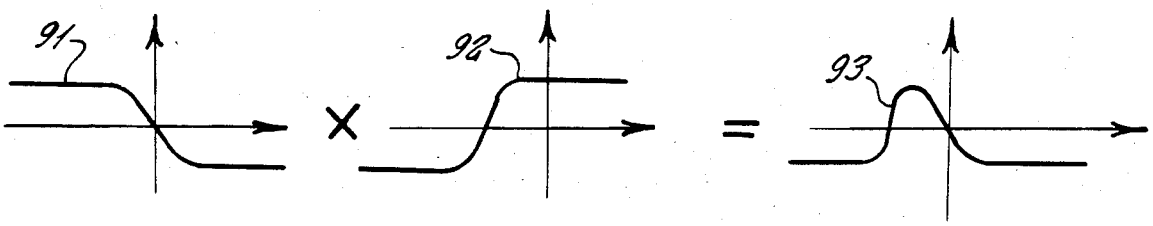
Fig. 9
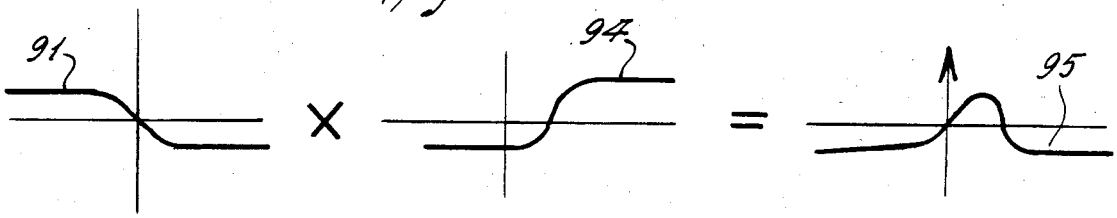
Fig. 10
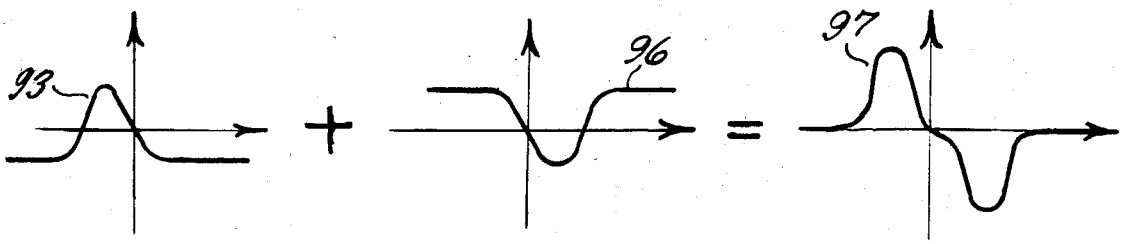

APPARATUS AND METHOD FOR PROCESSING AUDIO SIGNALS

FIELD OF THE INVENTION

The present invention relates to method and apparatus for amplitude-dependent frequency multiplication, and more particularly concerns bandwidth control of signals representing musical tones produced by an electrical musical instrument.

BACKGROUND OF THE INVENTION

Electrical musical instruments of the voltage-controlled synthesizer type generally modify the spectral envelope of a complex tone signal compounded from one or more oscillator outputs by passing the signal through one or more fixed or variable filters. Control of spectral envelope is an essential ingredient in the definition of musical timbres, and virtually all listeners prefer musical sounds with time-varying timbre over "dead" sound without variation. For example, the frequency variations which musicians call "vibrato" are time-varying timbral effects.

Voltage-controlled filters are almost universally employed for more complex spectral manipulations. Such filters may be of the low-, high-, or band-pass type, with the bandwidth dependent on an externally provided control voltage. Processing signals with such variable-bandwidth filters are called subtractive synthesis, and a variety of patents have been issued on musical instruments which make use of subtractive synthesis, e.g., Robert A. Moog, Electronic Music Synthesizer, U.S. Pat. No. 4,050,343.

Criticism has been directed at the inability of musical synthesizers, of the type well-known in the art, to generate "natural" sounds. An alternative method based on audio frequency modulation and implementation by a digital FM synthesizer has been developed recently by J. W. Chowning, Method of Synthesizing a Musical Sound, U.S. Pat. No. 4,018,121.

The Chowning digital FM Synthesizer uses several dozen digital integrated circuits to form a micro-programmed device with "a sine memory which is a read only memory." The basic purpose of the micro-program is to cyclically obtain values from the sine table stored in the sine memory and combine them with appropriate input values of carrier frequency $w_c$, modulation frequency $w_m$, modulation index I and amplitude A to calculate in real-time instantaneous output values of the form:

$$e=A \sin (w_c t+I(t) \sin w_m t). \qquad \text{(FM Equation)}$$

The key time-varying parameter is the modulation index I(t) which gives "life" to the calculated signal e through the course of a note. It is shown in standard texts, e.g., Mischa Schwartz, Information Transmission, Modulation, and Noise, A Unified Approach to Communication Systems, Second Edition, McGraw-Hill Book Company, 1970, that the bandwidth of e is directly proportional to the modulation index I (page 246). This is a direct consequence of the mathematics of taking the sine of a sine in the FM EQUATION.

While the digital FM synthesizer is preferred by some as more "natural" sounding for musical purposes than the voltage-controlled subtractive synthesizers, there are inherent disadvantages to the digital FM synthesizer. First, as a digital device it is not easily connected to analog synthesizers, and requires digital to analog converter apparatus for musicians seeking to take advantage of both technical realms. Second, the digital FM synthesizer is elaborate and costly to manufacture, requiring a large number of integrated circuits. Third, it is restrictive in relying on sinusoids for synthesizing controlled-bandwidth signals.

OBJECTS OF THE INVENTION

Accordingly, it is a principle object of the invention to provide an improved method and apparatus for processing input signals where the output bandwidth is proportional to the amplitude of an audio input signal, and wherein the problems of the prior art described above may be overcome.

It is a further object of the invention to utilize more complex functions than the sinusoid in the synthesis of variable bandwidth signals.

It is another object of the invention to provide bandwidth control using analog rather than digital devices.

It is another object of the invention to modify the bandwidth by purely time-domain processing rather than by filtering operations.

It is still another object to provide a relatively simple, more efficient apparatus, of inexpensive construction.

Yet another object is to utilize circuits which may be embodied in integrated circuits, further reducing their cost in mass production.

SUMMARY OF THE INVENTION

In general, the present invention provides a signal processing method and technique which exchanges amplitude for bandwidth. In other words, the input signal may have a narrow bandwidth and variable amplitude, and the corresponding output will have a relatively fixed amplitude and variable bandwidth.

In accordance with the method of the invention, this is accomplished by dividing the range of amplitude of the input signal into an odd number of equal intervals, including a central interval, detecting the interval of amplitude instantaneously occupied by said signal, shifting said instantaneous signal to the central interval and smoothing the resulting discontinuous signal with a continuous and bilaterally-tapered transfer function, to be defined and described below.

The shifting of the input as it passes into a series of upper or lower intervals effectively multiplies the frequency and limits the amplitude of the processed signal, and will be referred to as "modulizing" herein. The apparatus and circuitry will be referred to as a "modulizer".

The apparatus and circuitry for smoothing the discontinuous "modulized" signal will be referred to as the "continuator" herein and its output will be seen to have a bandwidth responsive to the amplitude of the input signal.

DESCRIPTION OF THE DRAWINGS

Other objects and advantages will become apparent upon reading the following detailed descriptions and accompanying drawings, in which:

FIG. 6, is a schematic diagram of a continuator in accordance with the invention.

FIG. 7, shows the transfer function of a differential amplifier employed in the preferred embodiment.

FIGS. 8, 9 and 10, are graphical computations illustrating the combination and use of differential amplifiers and multipliers in accordance with the invention.

DETAILED DESCRIPTION

Figure 1:
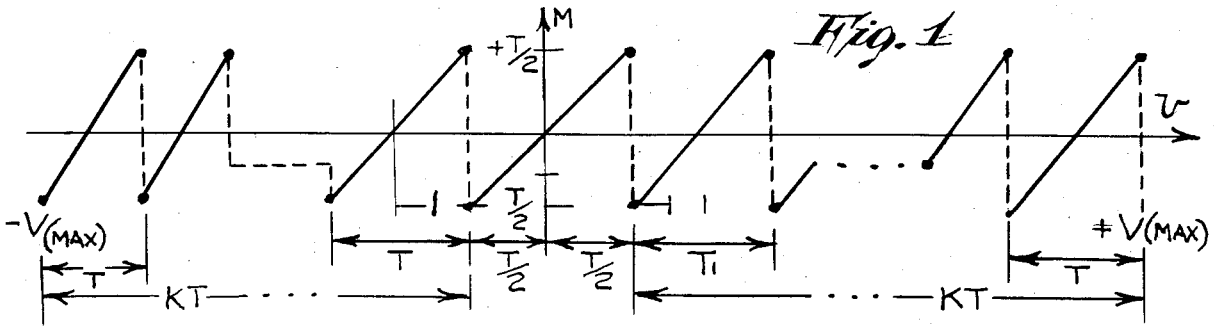
FIG. 1, is a graph of the transfer function of a modulizer in accordance with the invention.

Referring now to the drawings:

FIG. 1, illustrates the transfer function for a modulizer according to the invention. Curve 10, the modulizer transfer function, shows a sawtooth-shaped relationship between input voltage v and output voltage M. The sawtooth has 2K+1 intervals of width T volts, and the total range of amplitude is (2K+1)T chosen to accomodate the peak expected value ±V(MAX) of V. In particular, if v is itself an audio frequency sawtooth waveform with no DC offset and peak-to-peak amplitude at most T volts, and thus having instantaneous amplitude within the central interval −T/2 to +T/2, then the output M will merely be a replica of v, with no change in either amplitude or frequency. Of course, the modulizer transfer function need not be a perfect sawtooth. The rising segments may be monotonically increasing rather then strictly linearly increasing. Alternatively, the sawtooth may have linearly or monotonically decreasing segments.

Thus, T and K are chosen so that the range of amplitude of v is divided into an odd number of equal intervals, including the central interval where $-T/2 \leqq v \leqq +T/2$ and M(v) is merely a replica of v.

However, as v exceeds the +T/2 volts central interval threshhold, the output M is shifted, in this case reduced, by T volts, and continues to be reproduced, until it exceeds +3T/2, and is again reduced by T volts. Continuing in this way, if v crosses the +5T/2 threshhold, the output is again reduced by T volts, and each time it crosses a threshhold, the output is shifted downwards by T volts. The crossing of negative threshholds produces corresponding results, except for shifts upwards instead of downwards.

Thus for K threshholds, M(v) may be expressed:

$$M(v)=v-kT \text{ if } (k-T/2)T \leqq v \leqq (k+1/2)T \qquad \text{(Equation 1)}$$

where M(v) is the modulizer output for input v, k is an integer in the range of −K to +K, and K is selected as the upper limit on the frequency multiplication performed by the modulizer each time v passes a threshhold ±T/2, ±3T/2, . . . , ±(K+1/2)T volts. It is seen that M(v) has extremes of ±T/2 volts, and is discontinuous each time a threshhold ±(k+1/2)T is passed by input v, in effect "multiplying" the frequency of v as the threshholds are passed. The frequency-multiplied, discontinuous signal produced by the modulizer is then applied to a continuator, which will smooth out the discontinuities in the modulizer output.

Figure 2:
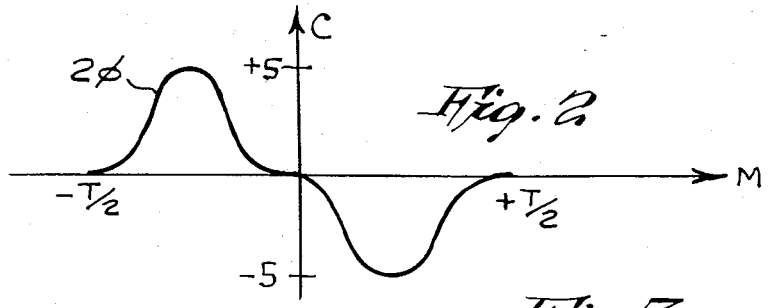
FIG. 2, is a graph of a continuator transfer function.

FIG. 2, illustrates the transfer function of a continuator circuit for performing the smoothing step. Curve 20, the continuator transfer function, shows a continuous relationship between inputs within the limits ±T/2 volts (the central interval) yielding outputs in the range of ±5 volts, with two important properties: (i) the output approaches zero, as the input approaches ±T/2 V; and (ii) the slope of the curve approaches zero as the input approaches ±T/2V. A transfer function having both these preperties shall be referred to as "continuous and bilaterally tapered" herein. Preferably, the continuator transfer function has a single minimum and a single maximum ±Cmax (e.g., ±5 volts) at M=±T/4, respectively, as shown in FIG. 2, but the function need only be continuous and smooth in the central interval, that is, between ±T/2. These properties insure that (i) the output signal C=C(M(v(t))) is a continuous function and that (ii) the switching transients arising from the discontinuities in the modulizer transfer function, (FIG. 1) are highly attenuated, even if there are variations in switching-time due to inaccuracies of circuit components.

Figure 3:
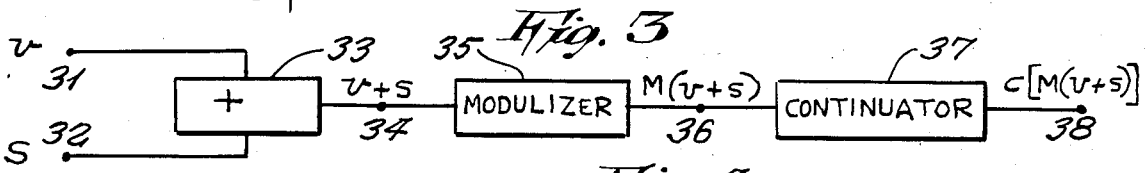
FIG. 3, is a block diagram illustrating a preferred embodiment of the method for processing audio signals in accordance with the present invention.
Figure 4:
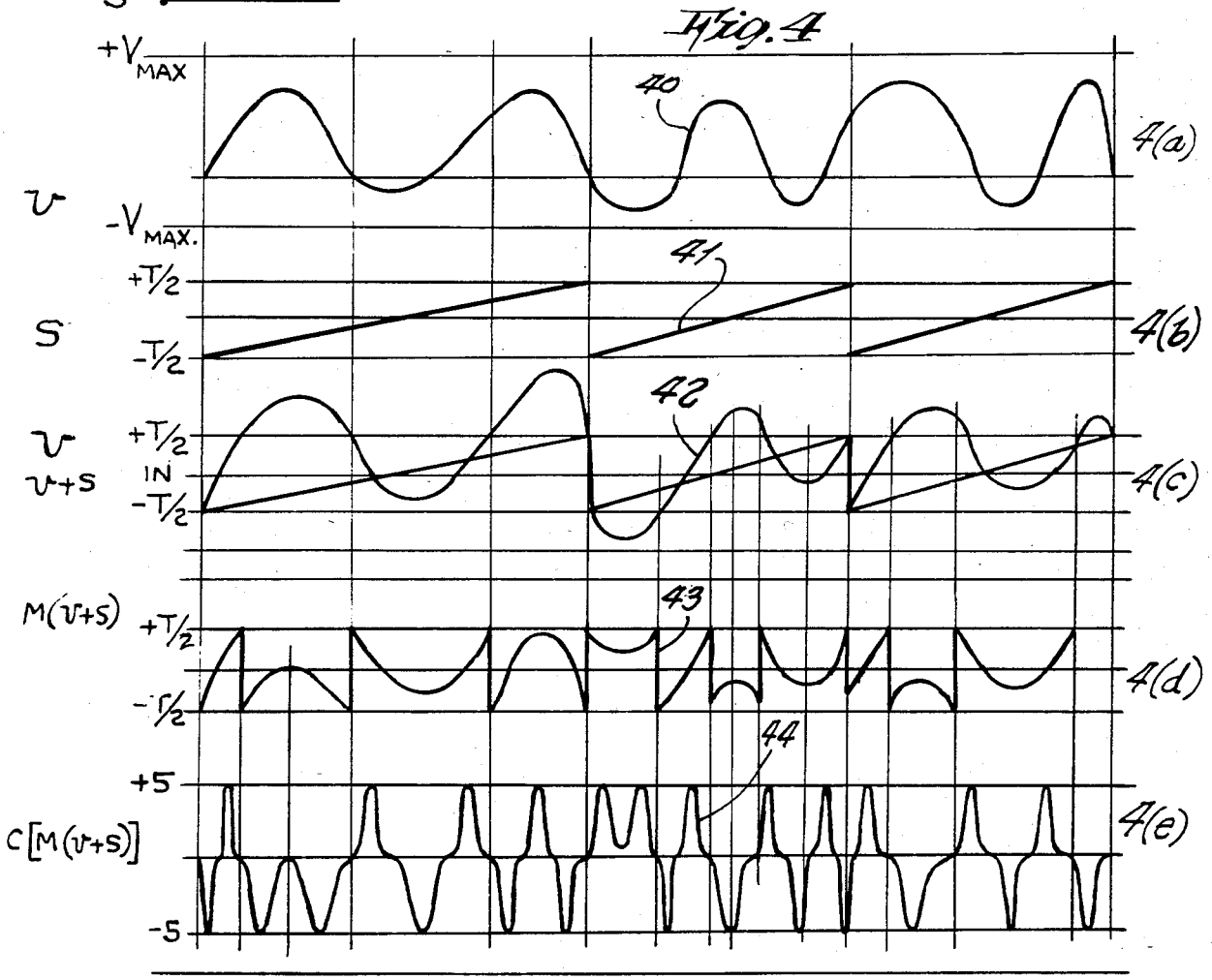
FIG. 4, is a set of curves illustrating the wave form of an audio input and its transformations after successive steps in the process in accordance with the invention.

The operation of the modulizer (FIG. 1) and continuator (FIG. 2) transfer functions in accordance with the method of the present invention, is illustrated in FIG. 3, which illustrates the method, and FIG. 4, which shows the processed signal v at each step of the method.

Referring to FIG. 3, a block diagram showing the steps of a preferred embodiment of the method of the invention, a variable amplitude audio signal v, at most ±V(max) (shown in FIG. 4*a*) is applied to one input terminal 31, of an analog addition circuit or "adder". At the other input terminal 32, a fixed amplitude sawtooth waveform s, with T volts p-p amplitude (shown in FIG. 4*b*) is applied.

For musical applications, the frequency of the sawtooth is that of the desired fundamental, and v+s is the audio input signal applied to the modulizer. However, a random frequency audio input signal v, as shown in FIG. 4*a*, may be directly applied to the modulizer without departing from the scope of the invention.

In the preferred embodiment shown herein, adder output 34, is a discontinuous signal, v+s (shown in FIG. 4*c*), which is then applied to modulizer 35. The intermediate output signal 36, of the modulizer (shown in FIG. 4*d*) is also a discontinuous signal, M(v+s), which is a constant amplitude signal of T volts p-p amplitude, and which is applied to the input to the continuator 37 for the last step in the process. The output of the continuator is a relatively smooth, continuous signal C(M(v+s)) (shown in FIG. 4*e*), and is the processed audio output signal.

It is apparent from the waveform in FIG. 4*e*, that the processed signal has constant amplitude ±5 volts p-p, that the processed signal has frequency components, in general, both above and below frequency of the "fundamental" sawtooth waveform of FIG. 4*b*, and that the relative amplitudes of these frequency components depend on the amplitude of the audio input signal 4*a*. Thus, variable amplitude and relatively narrow bandwidth at the input are exchanged for a relatively fixed amplitude and variable bandwidth at the output in accordance with the present invention.

Figure 5:
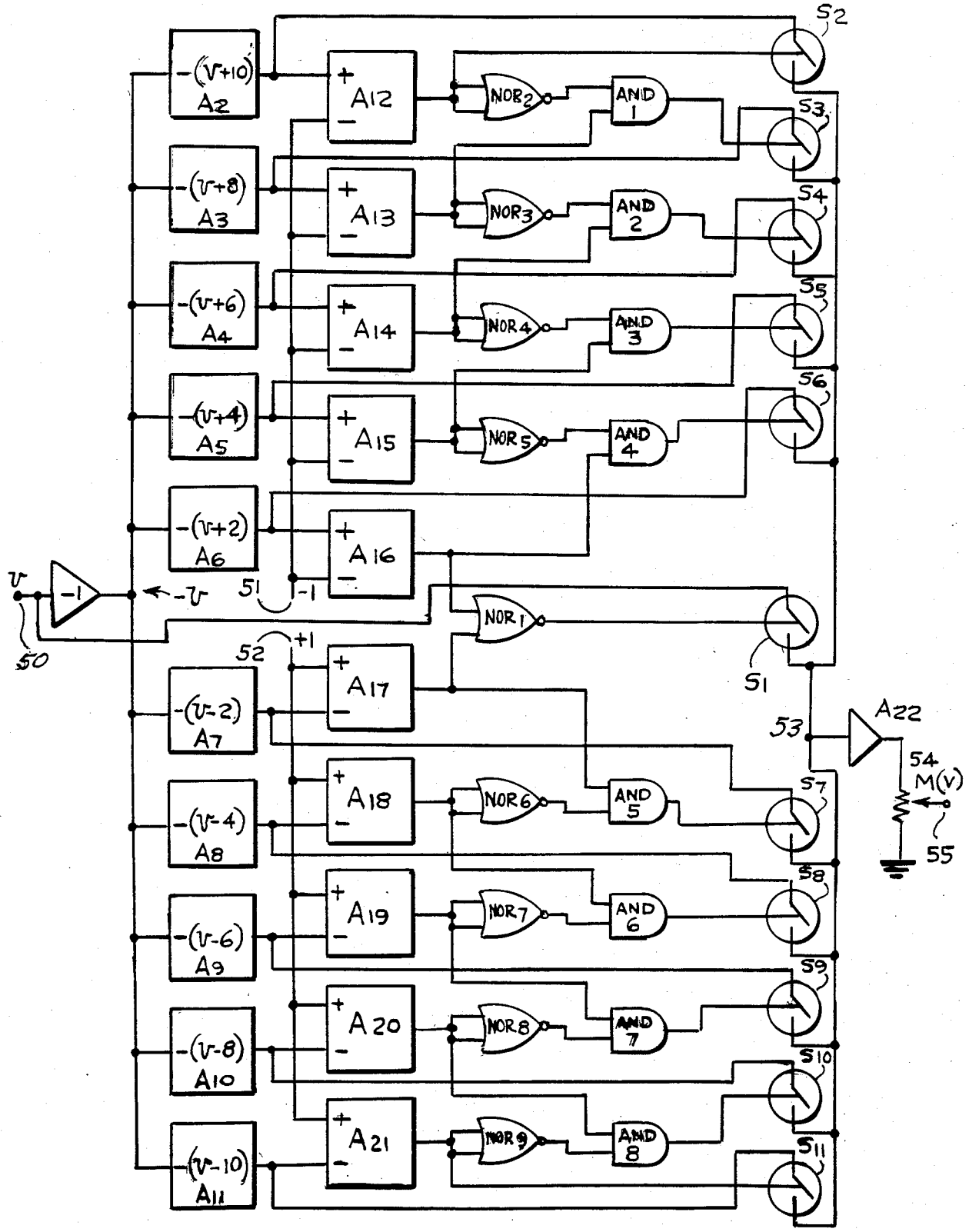
FIG. 5, is a schematic diagram for a preferred embodiment of a modulizer in accordance with the invention.

FIGS. 5–6, show detailed circuit diagrams for modulizer and continuator apparatus in accordance with the invention.

Referring to FIG. 5, the input signal v is applied to input terminal 50, of 1 unity gain inverter $A_1$. Input terminal 50, is also directly connected to analog switch $S^1$, to be described below. The output of $A^1$, is applied to the inputs of ten operational amplifiers $A_2$–$A_{11}$, which again invert but also shift the input signal v. The degree of shift is adjusted in each amplifier as shown, producing ten replicas of v in the form v±2k volts, (i.e., v−2, v+2, . . . , v−10) where k=1, 2, 3, 4, 5. The positively shifted replicas of op amps $A_2$–$A_6$, are applied to the (+input) terminals of op amp comparators $A_{12}$–$A_{16}$, as well as to switches $S_2$–$S_6$, respectively. These comparators have a −1 volt threshhold applied to their (−inputs) from terminal 51. Similarly, the negatively shifted outputs of $A_7$–$A_{11}$, are applied to the (−input) terminals of op amp comparators $A_{17}$–$A_{21}$, as well as to switches $S_7$–$S_{10}$, and the (+inputs) of $A_{17}$–$A_{20}$, have a +1 volt threshhold applied at terminal 52.

The outputs of analog switches $S_1$–$S_{11}$, are all connected to the input 53 of buffer amplifier $A_{22}$, the output of which is connected to and scaled by potentiometer 54, from which the modulizer output is taken at output terminal 55, for application to the continuator.

Logic circuits, comprising gates NOR 1–NOR 9, and gates AND 1–AND 8 control analog switches $S_1$–$S_{11}$, turning them "ON" and "OFF" by the connections shown in FIG. 5. These logic circuits can best be explained by illustrating their operation. For example, the outputs of comparators A16 and A17 are applied to gate NOR 1, which turns analog switch $S_1$ ON when neither A16 or A17 has output high, i.e., when input signal v crosses neither the +1 or −1 volt threshhold established by terminals 51 and 52. This is just the case when v remains within the central interval, $-1 \leqq v \leqq +1$. In this case, all other switches are OFF, as all other comparators outputs are LOW.

For another example, assume the input signal exceeds +1 volt but not +3 volts. The negatively shifted replica v−2 produced by $A_7$, passes the +1 volt threshhold set by terminal 52. Thus comparator $A_{17}$, has output HIGH and gate NOR 1 output LOW turning S1 OFF. Since A18 has output LOW, which output is connected to both inputs of NOR 5, gate AND 4, will have both inputs HIGH, gating analog switch S7 ON. Thus the portion of the input signal between +1 volt and +3 volt is effectively shifted down to lie between −1 volt and +1 volt, the central interval, and otherwise suffers no change. All other switches are OFF, as all other comparators are LOW.

For a third example, assume the input signal v ranges between +3 and +5 volts. The negatively shifted replica v-4, produced by A8, passes the +1 threshhold of terminal 52, triggering comparators A17 and A18 to output HIGH. NOR 1, is LOW, shutting off S1. A18, is HIGH, bringing NOR 6, LOW, shutting S7 OFF. However, A18's HIGH is also applied to AND 6, which is also HIGH (as A19 and thus NOR 7, are LOW) thus turning $S_8$ ON, and switching that portion of the input signal between +3 and +5 volts from A8 to terminal 53, the −input to amplifier A22. Thus the portion of the input signal between +3 and +5 volts is shifted down to lie between −1 and +1 volts and otherwise suffers no change. No other switches are ON.

As v increases into the next interval (e.g., +5 to +7) the next comparator (A19) is triggered HIGH, turning OFF the preceding switch 58, while turning ON the next higher switch 59.

Applying inputs with negative peaks produces corresponding results in the upper bank of switches (S-2–$S_6$) as the logic circuits are symmetrical.

Table I, on the following page, shows which replica is being switched to terminal 53, and the path of gates and switches followed for values of v between +11 volts and −11 volts.

TABLE I

| v | v±2K (shifter) | | Comparators HIGH | Logic Gate HIGH | Switch ON |
|---|---|---|---|---|---|
| 9–11 | v+10($A_2$) | | A12–A16 | | S2 |
| 7–9 | v+8($A_3$) | | A13–A16 | AND 1 | S3 |
| 5–7 | v+6 | A(4) | A14–A16 | AND 2 | S4 |
| 3–5 | v+4 | A(8) | A15–A16 | AND 3 | S5 |
| 1–3 | v+2 | A(6) | A16 | AND 4 | S6 |
| −1 to +1 | v | | — | NOR 1 | S1 |
| −1 to −3 | v−2 | $A_7$ | A17 | AND 5 | S7 |
| −3 to −5 | v−4 | $A_7$ | A17–A18 | AND 6 | S8 |
| −5 to −7 | v−6 | $A_9$ | A17–A19 | AND 7 | S9 |
| −7 to −9 | v−8 | $A_{10}$ | A17–A20 | AND 8 | S10 |
| −9 to −11 | v−10 | $A_{11}$ | A17–A21 | | S11 |

It is seen by assuming inputs with peaks between 11 volts and −11 volts, that at any instant only one analog switch is closed. Since all analog switch outputs are connected at the −input virtual ground of operational amplifier A22, the output of A22 consists of portions of the input signal v shifted by just the right amount to lie between −1 volt and +1 volt, the central interval, as shown in FIG. 4*d*.

Referring to FIG. 6, which shows the continuator circuit, the continuator input 60, is connected to two identical networks. In the upper network, input 60 is connected to the (+input) of amplifier A30, and the (−input) of amplifier A31, which has its (+input) grounded. The (−input) terminal of A30, is connected to the wiper of offsetting potentiometer 61, with positive and negative voltages, 66*a* and 66*b* respectively, applied to its end terminals. The outputs of A30 and A31 are applied to multiplier 63.

In the lower network, input 60 is connected to the (+input) of amplifier A32, which has its (−input) is connected to the wiper of offsetting potentiometer 62, with positive and negative voltages, 62*a* and 62*b* respectively, applied to its end terminals. Input 60, is also connected to the (−input) of amplifier A33, which has its (+input) grounded. The outputs of A32 and A33 are connected to multiplier 64. The output of multiplier 64 is inverted by inverter A34, and thereafter added to the output of multiplier 63, by adder 65. The output of adder A35 (and of the continuator) is taken at output terminal 65.

FIG. 7, shows the S-shaped transfer characteristics of differential amplifiers A30–A33. FIGS. 8–9, show the effect on these transfer characteristics of the connections and offsets shown in FIG. 6, in accordance with the invention.

Referring to FIG. 8, curve 91, shows the transfer characteristic of amplifier A31, which is the left-right reversal of curve 81, in FIG. 7, as input 60, is applied to the (−input) of A31, with its (+input) grounded. Curve 92, is the transfer characteristic (or "transfer function") of A30, which is that of curve 81, as input 60, is applied to the (+input) of A30, but curve 92, is shifted to the left by offsetting potentiometer 61. The outputs of A30 and A31 are applied to multiplier 63, which produces the transfer characteristic 93.

Referring to FIG. 9, which shows the operation of the lower network of FIG. 6, potentiometer 62, is adjusted to offset the characteristic of A32 to the right, in the opposite direction to the offset of A30, as shown in curve 94. A33 has characteristic curve 91. When the outputs of A32 and A33, are applied to multiplier 64, the produce is curve 95, a bellshaped curve shifted to the right. This product of multiplier 64, is inverted by A34, as shown in curve 96, in FIG. 9.

Referring to FIG. 10 when inverted product 96, is added to product 93, of multiplier 63, the result is a transfer characteristic 97, having the shape of FIG. 2, By proper offsetting and choice of parameters, the continuator circuit shown in FIG. 6, can have the necessary "continuous and bilaterally tapered" transfer characteristics required by the invention, and the desired limits of $\pm T/2$ and amplitude of 5 volts of FIG. 2.

It should be added that the continuator circuit may be used alone as an audio processing circuit. Variable amplitude audio inputs directly to the continuator produce widely varying timbral effects, useful in electronic music. The continuator alone has frequency doubling capability, (see FIGS. 4(*d*)–4(*e*)) and its non-linear characteristic introduces additional harmonics. The modulizer, with its numerous threshholds and intervals, greatly enhances these multiplicative effects.

In summary, the invention teaches a method for processing an audio input signal to achieve a variable bandwidth output signal useful in the synthesis of rich musical sounds. Taught are the steps of shifting the input, as it passes certain threshholds, into the central interval, producing an amplitude controlled frequency multiplier effect, called "modulizing" herein, and then eliminating discontinuities and producing a smooth continuous output, with frequency components and bandwidth responsive to the amplitude of the input. Circuits and apparatus for practicing the method are also taught.

It is seen that in the first preferred embodiment, a plurality of equally spaced, shifted replicas of the input signal were produced and one replica detected as said replica passed a fixed equally spaced upper or lower threshhold. Alternatively, these shifting effects could be achieved by a second preferred embodiment, not described in detail, in which the input signal is detected as it crosses a plurality of equally spaced upper and lower threshholds, and then shifted.

A novel form of smoothing function is taught, the bilaterally and centrally tapered transfer function, which alone can process and enrich an audio signal, particularly one with discontinuites, and which in combination with a modulizer, greatly enhances the timbral richness of audio inputs.

In the foregoing description, conventional circuitry for the inverters, comparators, analog switches, multipliers and other well known circuitry are not shown in detail. Differential amplifier circuits, their connections and transfer characteristics are well known, as illustrated in Millman and Halkias, Integrated Electronics: Analog and Digital Circuits and Systems, McGraw-Hill, 1972 (at page 511). Integrated circuits useful for the NOR and AND gates above are also well known, e.g., CMOS integrated circuits, types CD4001, and 74C08.

The present embodiments are merely illustrative and not restrictive and other embodiments are possible without departing from its spirit and essential characteristics.

What is claimed is:

1. In a method for producing musical signals with variable bandwidth responsive to input signal amplitude, the step comprising smoothing the discontinuities in a variable amplitude audio input in the time domain with a continuous and bilaterally tapered transfer function.

2. Apparatus for smoothing the discontinuities in an input signal in the time domain with a continuous and bilaterally tapered transfer function comprising, means for applying an input signal simultaneously to the non-inverting inputs of a first and a third differential amplifier and to the inverting input of a second and a fourth differential amplifier; means for shifting the output of said first amplifier by afixed positive interval; means for shifting the output of said third amplifier by an equal negative interval; means for multiplying the outputs of of said first and second amplifier; means for multiplying the output of said third and fourth amplifiers and inverting the product thereof; and means for adding the product of said first and second amplifiers and inverted product of said third and fourth amplifiers.

3. A method for producing musical signals with variable bandwidth responsive to input signal amplitude, the steps comprising:

applying an audio signal with its range of amplitude divisible into an odd number of equal intervals, including a central interval;

detecting the interval occupied by said signal;

shifting said signal from the detected interval to the central interval as it passes into any other interval;

and smoothing the discontinuities in said shifted signal in the time domain.

4. The method of claim 3, in which said shifted signal is smoothed with a continuous and bilaterally tapered transfer function.

5. The method of claim 3, wherein the audio signal is added to a sawtooth waveform prior to application thereof.

6. The method of claim 3, wherein the audio signal is added to a periodic sawtooth waveform of a desired fundamental frequency.

7. A method for producing musical signals with variable bandwidth responsive to input signal amplitude, the steps comprising:

applying an audio input signal with its range of amplitude divisible into an odd number of equal intervals, including a central interval;

producing a series of positively and negatively shifted replicas of said input signal, each of said replicas shifted by a multiple of said interval;

detecting which one of said input and shifted replicas occupies the central interval;

and smoothing the discontinuities in the detected input or replica in the time domain.

8. The method of claim 7, in which the switched signal is smoothed with a continuous and bilaterally tapered transfer function.

9. Apparatus for producing musical signals with variable bandwidth responsive to input signal amplitude, comprising:

means for applying an audio input signal with its range of amplitude divisible into an odd number of equal intervals, including a central interval;

means for producing a series of positively and negatively shifted replicas of said input signal, each of said replicas shifted by a multiple of said interval;

means for detecting said input or the one of said shifted replicas which occupies said central interval;

means for switching the detected signal;

and means for smoothing the discontinuities in the switched signal in the time domain.

10. The apparatus of claim 9 in which the smoothing means comprises:

means for applying an input signal simultaneously to the non-inverting inputs of a first and a third differential amplifier and to the inverting inputs of a second and a fourth differential amplifier;

means for shifting the output of said first amplifier by affixed positive interval;

means for shifting the output of said fourth amplifier by an equal negative interval;

means for multiplying the outputs of said first and second amplifier;

means for multiplying the output of said third and fourth amplifiers and inverting the product thereof;

and means for adding the product of said first and second amplifiers and inverted product of said third and fourth amplifiers.

11. Apparatus for producing musical signals with variable bandwidth responsive to input signal amplitude, said input signal having a range of amplitude divisible into an odd number of equal intervals, including a central interval, comprising:

means for applying a variable amplitude input signal;

means for switching said input signal when it occupies said central interval;

means for producing a series of positively shifted replicas of said input signal, each of said replicas shifted by a multiple of said interval;

means for comparing each of said positively shifted replicas with the lower threshhold of the central interval;

means for producing a series of negatively shifted replicas of said input signal, each of said replicas shifted by a multiple of said interval;

means for comparing each of said negatively shifted replicas with the upper-threshhold of the central interval;

means for switching the one of said shifted replicas passing a threshhold into the central interval and occupying the central interval, and means for smoothing the discontinuities in the switched signal in the time domain.

12. The apparatus of claim 11, in which the smoothing means has a continuous and bilaterally tapered transfer function.

13. The apparatus of claim 11, in which the smoothing means comprises:

means for applying an input signal simultaneously to the non-inverting inputs of a first and a third differential amplifier and to the inverting inputs of a second and a fourth differential amplifier;

means for shifting the output of said first amplifier by a fixed positive interval;

means for shifting the output of said third amplifier by an equal negative interval;

means for multiplying the outputs of said first and second amplifier;

means for multiplying the output of said third and fourth amplifiers and inverting the product thereof;

means for adding the product of said first and second amplifiers and inverted product of said third and fourth amplifiers.

* * * * *